US005730760A

United States Patent [19]

Kirk et al.

[11] Patent Number: 5,730,760

[45] Date of Patent: Mar. 24, 1998

[54] FABRIC WASHING COMPOSITION AND METHOD FOR INHIBITING DEPOSITION OF DYE

[75] Inventors: Thomas Cleveland Kirk, Ivyland; Curtis Schwartz, Ambler; Richard James Tallent, Lafayette Hill; Thomas Lawrence Pytlewski, Philadelphia, all of Pa.

[73] Assignee: Rohm and Haas Company, Philadelphia, Pa.

[21] Appl. No.: 676,551

[22] Filed: Jul. 9, 1996

Related U.S. Application Data

[60] Provisional application No. 60/001,056, Jul. 11, 1995.

[51] Int. Cl.[6] ..... D06L 1/16; C11D 3/37

[52] U.S. Cl. ..... 8/137; 510/299; 510/300; 510/517; 510/528

[58] Field of Search ..... 8/137; 510/299, 510/300, 517, 528

[56] References Cited

U.S. PATENT DOCUMENTS

| | | | |
|---|---|---|---|
| 4,379,059 | 4/1983 | Hockey et al. | 510/522 |
| 4,444,561 | 4/1984 | Denzinger et al. . | |
| 4,772,290 | 9/1988 | Mitchell et al. | 8/111 |
| 4,880,497 | 11/1989 | Pfohl et al. . | |
| 4,921,621 | 5/1990 | Costello et al. . | |
| 5,380,447 | 1/1995 | Kirk et al. . | |
| 5,409,629 | 4/1995 | Shulman et al. . | |
| 5,534,182 | 7/1996 | Kirk et al. . | |

FOREIGN PATENT DOCUMENTS

| | | |
|---|---|---|
| 2104507 | 2/1994 | Canada . |
| 2104728 | 2/1994 | Canada . |
| 2115529 | 8/1994 | Canada . |
| 341205 | 11/1989 | European Pat. Off. . |
| 510246 | 10/1992 | European Pat. Off. . |
| 538228 | 4/1993 | European Pat. Off. . |
| 579295 | 1/1994 | European Pat. Off. . |
| 3124210 | 12/1982 | Germany . |
| 4244386 | 6/1994 | Germany . |
| 4413720 | 10/1995 | Germany . |

OTHER PUBLICATIONS

Mode of Action of Polymers with Dye Transfer–Inhibiting Properties, H.U. Jager and W. Denzinger, Tenside, Surfactants, Deterg. 28(6), pp. 428–433 (1991). (Month Unknown).

*Primary Examiner*—Alan Diamond

*Attorney, Agent, or Firm*—Ronald S. Hermenau; Kimberly R. Hild

[57] ABSTRACT

The present invention provides a fabric washing composition and aqueous treatment solution for inhibiting dye from transferring from one fabric to the same or different fabric in a fabric washing process. The fabric washing composition and aqueous treatment solution contain at least one dye deposition inhibiting polymer. The dye deposition inhibiting polymer contains, as polymerized units, from 5 to 100 weight percent of at least one vinyl amide monomer and from 0 to 95 weight percent of one or more vinyl ester monomers. The present invention also provides a method for inhibiting the deposition of dye by adding at least one of dye deposition inhibiting polymer useful in the present invention to a fabric washing process where dye may be released.

19 Claims, No Drawings

FABRIC WASHING COMPOSITION AND METHOD FOR INHIBITING DEPOSITION OF DYE

This application claims the benefit of provisional application Ser. No. 60/001,056, filed Jul. 11, 1995.

BACKGROUND

The present invention relates to a fabric washing composition and method for inhibiting the deposition of dye onto fabric in a fabric washing process. More specifically, this invention relates to using certain polymers in a fabric washing process, to inhibit dye from dyed fabric, from transferring to another fabric or to a different location on the same fabric.

By "fabric washing process," we mean any process for treating fabric in a solution, where dye is released. The fabric washing process includes a process where dye is released intentionally or inadvertently from the fabric. For example, the fabric washing process may be conducted to clean or soften the fabric where dye may be inadvertently released from the fabric. The fabric washing process may also be conducted to fade the fabric where dye may be intentionally released from the fabric.

The fabric washing process may be carried out to treat the fabric in one or more ways at the same time. For example, the fabric washing process may be conducted to clean, soften, and fade the fabric.

The fabric washed in a fabric washing process may be any type of dyed fabric washed in a solution. For example, fabric includes natural fabric, synthetic fabric, woven fabric, nonwoven fabric, articles containing fabric such as clothing, shoes, table linens, or napkins.

The fabric washing process includes, for example, a stonewashing, prewashing, home laundering, or institutional or industrial laundering process.

In a stone washing process, fabric, usually denim, is treated, to intentionally release dye from the fabric to nonuniformly fade the fabric. The stonewashing process may also, for example, soften the fabric and make the fabric surface appear fuzzy and worn. A common problem in a stone washing process is that dye released from the fabric tends to redeposit on the same or different fabric. For example, when stone washing blue jeans, the released dye tends to redeposit undesirably onto the white pockets and seams of the jeans or back onto the denim fabric.

In a prewashing process, including acid washing, excess dye is typically bled from the fabric to uniformly fade the fabric. The prewashing process may also be used for example, to soften or preshrink the fabric. The dye in a prewashing process may be released intentionally or inadvertently. A common problem in a prewashing process is that the released dye tends to undesirably redeposit back onto the same or different fabric.

In a home laundering or institutional or industrial laundering process, fabric is treated for such purposes as cleaning or softening the fabric. By "home laundering process" we mean a process conducted in equipment designed for small quantities of fabric, for example, less than about 6 kilograms of fabric. By "institutional or industrial laundering process" we mean a process conducted in equipment for larger quantities of fabric, such as for example, greater than or equal to about 6 kilograms of fabric.

During the home laundering or institutional or industrial laundering process, dye may be inadvertently released. The amount of dye inadvertently released in a home or institutional or industrial laundering process depends on such factors as the type of dye and the type of fabric to which the dye is absorbed. The amount of dye released also depends on the fabric washing process conditions such as the temperature of the wash, the pH of the wash, and the type of detergent used. For example, higher bath temperatures in the wash will promote the release of dye. A common problem during the home laundering or industrial laundering process is that dye released from the fabric during the laundering process tends to redeposit on a different fabric or to an undesirable location on the same fabric.

Polymers have been used to inhibit the deposition of dye in the fabric washing process. It is believed the polymers may act to inhibit the deposition of dye by several different mechanisms. For example, where dye is inadvertently released from the fabric, the polymers may inhibit the release of dye from the fabric in the fabric washing process. Where dye is released intentionally or inadvertently from the fabric, the polymers may act to inhibit the redeposition of the released dye onto the fabric. The term "inhibit dye deposition" means that the polymer may act by any mechanism, including those mechanisms specifically mentioned herein, to prevent the transfer of dye from one fabric to another fabric or to the same fabric in a different location.

Identifying one or more polymers to inhibit dye deposition is difficult because of the different types of dyes used to color fabrics. As a result, one or more different types of dyes may need to be inhibited from depositing in a fabric washing process. Common fabric dyes are generally classified in one of the following categories: direct, acid, disperse, reactive, basic, and vat. For example, Chicago Sky Blue is a dye for coloring fabric blue and is classified in the Colour Index as a direct dye and has the name Direct Blue Number 1. Further examples of dyes which fall within these categories can be found in the Colour Index, Volumes 1 to 5, third edition, published by the Society of Dyers and Colourists, Yorkshire, England and the American Association of Textile Chemists and Colourists, Research Triangle Park, North Carolina, 1971.

The dyes within these categories may have very different properties. For example, the dyes may be cationic, anionic, nonionic or amphoteric in an aqueous solution. Dyes belonging to the direct, reactive, and acid dye categories, are generally anionic in an aqueous solution. Dyes belonging to the basic dye category are generally cationic in an aqueous solution. Finally, dyes classified as vat and disperse dyes are generally nonionic in an aqueous solution, but can be anionic or nonionic depending on the dye and the pH of the aqueous solution. The difficulty has been to identify polymers which will inhibit the deposition of these different types of dyes in the fabric washing process.

The polymers used for inhibiting the deposition of dye must also be compatible in the detergent composition and fabric washing process so as not to hinder the cleaning performance or damage the fabric.

CA 2115529 to Antwerpen et al., hereinafter referred to as the "'529 patent," teaches the use of certain copolymers to prevent reabsorption of dissolved dyes. The copolymers disclosed in the '529 patent contain from 75 to 95 weight percent of vinyl monomers free from carboxylic acid and amide groups; from 5 to 20 weight percent of at least one carboxylic acid amide, and from 0 to 5 weight percent of carboxylic acid containing monomers.

CA 2104507 also to Antwerpen et al., herein after referred to as the "'507 patent" teaches the use of copolymers containing from 5 to 90 weight percent of acrylamidoalkylenesulfonic acid, and from 5 to 90 weight percent vinyl acetamide monomers.

The copolymers in the '507 and '529 patents have the disadvantage of tending to be costly. The copolymers in the '507 patent also have the disadvantage of containing sulfonic acid groups which tend to be less effective in inhibiting the deposition of anionic or nonionic dyes.

The problem addressed by the present invention is to provide certain water soluble or water dispersible polymers which effectively inhibit dye deposition of many different dye types including anionic or nonionic dyes. Another problem addressed by the present invention is to provide cost effective polymers for inhibiting the deposition of dye.

STATEMENT OF INVENTION

The present invention provides a fabric washing composition for inhibiting deposition of dye, comprising: at least one additive selected from the group consisting of a surfactant, fabric softening agent and combinations thereof, and from 0.01 to 20 weight percent, based on the total weight of the composition, of at least one dye deposition inhibiting polymer, wherein the dye deposition inhibiting polymer comprises, as polymerized units, based on total weight of monomer from 5 to 100 weight percent of at least one vinyl amide monomer, from 0 to 95 weight percent of one or more vinyl ester monomers, less than 3 weight percent of one or more acrylamide monomers, and less than 3 weight percent of one or more ethylenically unsaturated carboxylic acid monomers.

The present invention also provides a method of inhibiting deposition of dye onto fabric in a fabric washing process, comprising:

a) forming a bath comprising water, at least one dyed fabric, and at least one of the dye deposition inhibiting polymer;

b) treating the dyed fabric in the bath; and c) contacting the dye deposition inhibiting polymer with the dyed fabric in the bath for the duration of the fabric washing process to inhibit the deposition of dye.

The present invention also provides an aqueous treatment solution for inhibiting the deposition of dye comprising: water, surfactant, and from 1 ppm to 10,000 ppm of at least one of the dye deposition inhibiting polymer.

DETAILED DESCRIPTION

By the term "bath," we mean an aqueous treatment solution containing the fabric to be treated. By "aqueous treatment solution," we mean a solution used to treat the fabric in the fabric washing process. For, example, the aqueous treatment solution may be used to clean, soften, or fade the fabric.

The dye deposition inhibiting polymer useful in the present invention is water soluble or water dispersible in the fabric washing process.

The dye deposition inhibiting polymer useful in this invention is preferably effective in inhibiting the deposition of a variety of different dyes including direct, acid, reactive, disperse, basic and vat dye types. The dye deposition inhibiting polymer is also preferably effective in inhibiting the deposition of dyes when the dyes are anionic, cationic, nonionic and amphoteric in the aqueous treatment solution.

The dye deposition inhibiting polymer is formed from, as polymerized units, of at least one vinyl amide monomer of Formula (I):

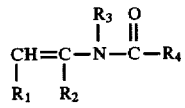

Formula (I)

where $R_1$, $R_2$, and $R_3$ are each independently selected from hydrogen, or a straight, cyclic, or branched chain $C_1$–$C_{10}$ alkyl group. Preferably $R_1$, $R_2$, and $R_3$, are each independently selected from hydrogen or a straight or branched $C_1$ to $C_4$ alkyl group. Most preferably $R_1$ and $R_2$ are hydrogen. Most preferably $R_3$ is hydrogen or a methyl group. $R_4$ is hydrogen, a straight, cyclic or branched chain $C_1$–$C_{18}$ alkyl, aryl, or alkylaryl group, or a substituent of Formula III:

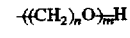

Formula III where n is an integer from 1 to 6 and m is an integer from 1 to 30. Preferably, $R_4$ is hydrogen or a straight or branched $C_1$ to $C_{10}$ alkyl group.

The vinyl amide monomer includes for example N-vinylformamide, N-vinyl acetamide, or N-vinyl-N-methyl acetamide or combinations thereof.

Preferably, the dye deposition inhibiting polymer is formed from 5 to 100 weight percent, preferably from 15 to 70 weight percent, and most preferably 20 to 40 weight percent of the vinyl amide monomer based on the total weight of monomer used to form the dye deposition inhibiting polymer.

The dye deposition inhibiting polymer may optionally be formed from, as polymerized units, of one or more vinyl ester monomers of Formula II:

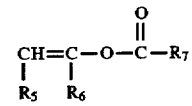

Formula (II)

where $R_5$ and $R_6$ are each independently selected from hydrogen, or a straight, cyclic, or branched chain $C_1$–$C_{10}$ alkyl group; where $R_7$ is selected from hydrogen, a straight, cyclic or branched chain $C_1$–$C_{18}$ alkyl, aryl, or alkylaryl group, or a substituent of Formula III. Preferably $R_5$ and $R_6$ are each independently selected from hydrogen or methyl. Preferably $R_7$ is hydrogen, a straight, cyclic or branched chain $C_1$–$C_{18}$ alkyl, aryl, or alkylaryl group, or a substituent of Formula (III):

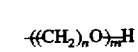

Formula (III)

where n is an integer from 1 to 6 and m is an integer from 1 to 30. Preferably, $R_7$ is a straight or branched $C_1$ to $C_{10}$ alkyl group.

The vinyl ester monomers include for example vinyl acetate, vinyl propionate, vinyl butyrate, vinyl pivalate, vinyl laurate, or vinyl decanoate or combinations thereof.

Preferably, the dye deposition inhibiting polymer is formed from 0 to 95 weight percent, more preferably from 30 to 85 weight percent, and most preferably 60 to 80 weight percent of the vinyl ester monomers based on the total weight of monomer used to form the dye deposition inhibiting polymer.

The dye deposition inhibiting polymer may also be formed from one or more optional other ethylenically unsaturated monomers. Preferably the other ethylenically unsaturated monomers do not contain groups which are anionic in the fabric washing process. The other ethylenically unsaturated monomers are also preferably monoethylenically unsaturated.

Optional other monomers include $C_2$ to $C_{20}$ ethylenically unsaturated monomers for example olefins, such as ethylene, propylene, or isobutylene; styrene; other vinyl ethers such as vinyl methyl ether, vinyl ethyl ether, isopropyl vinyl ether or vinyl n-butyl ether; acrylonitrile; methacrylonitrile; alkyl esters of acrylic or methacrylic acids such as methyl acrylate, ethyl acrylate, butyl acrylate, methyl methacrylate, ethyl methacrylate, butyl methacrylate or isobutyl methacrylate; hydroxyalkyl esters of acrylic or methacrylic acids such as hydroxyethyl acrylate, hydroxypropyl acrylate, hydroxyethyl methacrylate, or hydroxypropyl methacrylate; allyl alcohol; dialkyl esters of maleic acid or fumaric acid such as dibutyl maleate, dihexyl maleate, dioctyl maleate, dibutyl fumarate, dihexyl fumarate or dioctyl fumarate; allyl esters such as allyl acetate; or vinyl carbonate such as vinylene carbonate or combinations thereof.

Preferably, the dye deposition inhibiting polymer is formed from 0 to 50 weight percent, preferably from 1 to 20 weight percent, and most preferably from 1 to 10 weight percent of the optional other ethylenically unsaturated monomers based on the total weight of monomer used to form the dye deposition inhibiting polymer.

The dye deposition inhibiting polymer preferably contains less than 3 weight percent of one or more ethylenically unsaturated carboxylic acid monomers, based on the total weight of monomer. Preferably the dye deposition inhibiting polymer contains from 0 to 1.5 weight percent, and more preferably from 0 to 0.5 weight percent of ethylenically unsaturated carboxylic acid monomers.

The ethylenically unsaturated carboxylic acid monomers contain one or more carboxylic acid groups. The carboxylic acid groups may be neutralized or unneutralized. Examples of ethylenically unsaturated carboxylic acid monomers include acrylic acid, methacrylic acid, maleic acid, itaconic acid or salts thereof.

The dye deposition inhibiting polymer preferably contains less than 3 weight percent of one or more acrylamide monomers. Preferably the dye deposition inhibiting polymer contains from 0 to 1.5 weight percent and more preferably from 0 to 0.5 weight percent of acrylamide monomers.

The acrylamide monomers are derived from acrylamide. Examples of monomers derived from acrylamide include acrylamide, N,N-dimethylacrylamide, acrylamidoalkylenesulfonic acid, such as 2-acrylamido-2-methyl-propanesulfonic acid, or acrylamide monomers of Formula (IV)

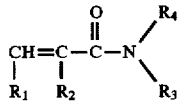

Formula (IV)

wherein, $R_1$, $R_2$, $R_3$, and $R_4$ are independently selected from H or a $C_1$ to $C_{10}$ alkyl group.

The weight average molecular weight of the dye deposition inhibiting polymer is preferably from 5,000 to 200,000; more preferably from 10,000 to 100,000; and most preferably from 20,000 to 60,000 as measured by gel permeation chromatography using dimethyl formamide as the solvent and polyvinyl pyrrolidone having a weight average molecular weight of 40,000 as a standard.

The dye deposition inhibiting polymer useful in the present invention may be prepared by conventional free radical polymerization methods well known to those skilled in the art. For example, the dye deposition inhibiting polymer may be prepared by a solvent polymerization process, water in oil emulsion polymerization process, oil in water emulsion polymerization process, or suspension polymerization process. Preferably, the dye deposition inhibiting polymer is prepared by an oil in water emulsion process. Suitable polymerization processes may be found in U.S. Pat. Nos. 4,774,285; 5,300,566; or 5,086,111.

Generally, the dye deposition inhibiting polymer is used in any step of the fabric washing process where dye may be released from dyed fabric into the aqueous treatment solution. For example, the dye deposition inhibiting polymer may be added to the bath where fabric is 1) stonewashed; 2) prewashed; 3) cleaned; or 4) softened.

The dye deposition inhibiting polymer may also be added to the fabric washing process where the fabric is neutralized in a bath to inactivate chemicals such as bleach or caustic. The dye deposition inhibiting polymer may also be added to a rinse cycle of a fabric washing process where residual chemicals used in the fabric washing process are removed.

The amount of dye deposition inhibiting polymer added to the aqueous treatment solution is that concentration needed to inhibit the deposition of dye. Generally, as the concentration of released dye is increased in the aqueous treatment solution, more dye deposition inhibiting polymer will be needed to effectively inhibit the deposition of dye. Preferably, in a fabric washing process, from 5 ppm to about 10,000 ppm; more preferably from 10 to 1000 ppm, and most preferably from 25 to 500 ppm by weight of at least one dye deposition inhibiting polymer is added to the aqueous treatment solution based on the total weight of the aqueous treatment solution.

The dye deposition inhibiting polymer may be added to the fabric washing process separately or may be added to the fabric washing process with other chemicals. For example the dye deposition inhibiting polymer may be formulated into a fabric washing composition which is then added to the fabric washing process.

Typically, the order of addition in the fabric washing process is to add to a washing machine according to machine capacity instructions 1) the fabric, 2) the water, and 3) the dye transfer inhibiting polymer optionally formulated in a fabric washing composition. However, it is theoretically possible to reverse the order of the steps, and for the accomplishment of dye transfer inhibition, there is no preferred order of addition.

For example, the water and dye deposition inhibiting agent may be added first, followed by adding the fabric second. A second alternative is the fabric and water may be added first, followed by adding the dye deposition inhibiting agent second. A third alternative is the dye deposition inhibiting agent may be added first, followed by adding the fabric second, and then adding the water. Finally, the fabric, water, and dye deposition inhibiting agent may be added simultaneously. Optionally, the dye deposition inhibiting polymer may be added after the fabric washing process has started. After forming a bath of fabric, water, and dye deposition inhibiting polymer, the fabric is treated in the aqueous treatment solution. The fabric may be treated for example by cleaning, softening, or fading the fabric or combinations thereof. The fabric may also be treated for example by rinsing or neutralizing the fabric in the fabric washing process.

To inhibit dye deposition, the dye deposition inhibiting polymer is brought into contact with the fabric and in contact with any released dye in the bath. Contacting is preferably accomplished through agitation of the bath.

The amount of time required for contact of the dye and fabric with the dye transfer inhibiting polymer is that time necessary to treat the fabric. For example, in a stonewashing process, the wash cycle may take from about 30 to 60 minutes to release the desired amount of dye. In a prewashing process, the wash cycle for example may take from about 15 to about 30 minutes to complete. In a home laundering process, the wash cycle may typically take from about 5 to 30 minutes to clean the fabric.

The dye deposition inhibiting polymer is preferably effective in inhibiting the deposition of dye at temperatures from about 5° C. to about 95° C. Additionally, the dye deposition inhibiting polymer is preferably effective in inhibiting the deposition of dye in an aqueous treatment solution having an aqueous pH of from about 2 to about 13.

At least one dye deposition inhibiting polymer of the present invention may optionally be formulated into a fabric washing composition which is then added to the aqueous treatment solution of the fabric washing process. The fabric washing composition may be added to the aqueous treatment solution in the fabric washing process for example to clean, soften or fade the fabric or combinations thereof.

The fabric washing composition comprises from 0.01 to 20 weight percent of at least one dye deposition inhibiting polymer and at least one additive selected from a surfactant, fabric softening agent, or combinations thereof. Preferably the concentration of dye deposition inhibiting polymer in the fabric washing composition is from 0.1 to 10 weight percent, more preferably from 0.4 to 5 weight percent based on the total weight of the composition.

Other additives contained in the fabric washing composition will depend on the intended use for the fabric washing composition in the fabric washing process. Other additives include for example one or more builders, solvents, water, inert diluents, buffering agents, bleaching agents, corrosion inhibitors, other dye deposition inhibiting agents, graying inhibitors, enzymes, anti-redeposition agents, stabilizers, perfumes, opacifiers, whiteners or combinations thereof.

The fabric washing composition may be a solid or liquid composition. If the composition is solid, the composition may be in any of the usual physical forms, such as for example powders, beads, flakes, bars, tablets, noodles, pastes, and slurries.

If the fabric washing composition is intended for cleaning it is prepared in the conventional manner and is usually based on surfactants, and optionally, on either precipitant or sequestrant builders. The fabric washing composition for cleaning may contain, in addition to the at least one dye deposition inhibiting agent and surfactant, one or more builders, solvents, water, inert diluents, buffering agents, fabric softening agents, bleaching agents, corrosion inhibitors, other dye deposition inhibiting agents, graying inhibitor, enzymes, anti-redeposition agents, stabilizers, perfumes, whiteners, opacifiers or combinations thereof.

A fabric washing composition used for softening fabric may comprise for example, from 25 to 95 weight percent water; from 2 to 60 weight percent of at least one fabric softening agent, and from 0.01 to 20 weight percent of at least one dye deposition inhibiting polymer. The fabric washing composition for softening fabric may also contain other adjuvants well known to those skilled in the art. For example, viscosity modifiers, germicides, fluorescers, perfumes, acids, soil resistant agents, colorants, antioxidants, anti-yellowing aids, and ironing aids may be included in the composition. Additionally, the fabric softening formulation may include solvents.

A fabric washing composition for fading fabric may comprise for example surfactants, builders, solvents, inorganic electrolytes, cellulase enzymes, or antioxidants, or combinations thereof.

In general, the surfactants constitute from 0 to 50, preferably from 2 to 50 weight percent, and more preferably 5 to 45 percent by weight of the fabric washing composition. In the aqueous treatment solution, the surfactant is preferably at a concentration of from 25 ppm to 5000 ppm; more preferably from 75 ppm to 750 ppm by weight based on the total weight of the aqueous treatment solution.

Suitable surfactants include for example nonionic, anionic, cationic, or amphoteric surfactants. The surfactants usable in the fabric washing composition may also be soaps.

Anionic surfactants include for example from $C_8$ to $C_{12}$ alkylbenzenesulfonates, from $C_{12}$ to $C_{16}$ alkanesulfonates, from $C_{12}$ to $C_{16}$ alkylsulfates, from $C_{12}$ to $C_{16}$ alkylsulfosuccinates or from $C_{12}$ to $C_{16}$ sulfated ethoxylated alkanols.

Nonionic surfactants include for example from $C_6$ to $C_{12}$ alkylphenol ethoxylates, from $C_{12}$ to $C_{20}$ alkanol alkoxylates, and block copolymers of ethylene oxide and propylene oxide. Optionally, the end groups of polyalkylene oxides can be blocked, whereby the free OH groups of the polyalkylene oxides can be etherified, esterified, acetalized and/or aminated. Another modification consists of reacting the free OH groups of the polyalkylene oxides with isocyanates. The nonionic surfactants also include $C_4$ to $C_{18}$ alkyl glucosides as well as the alkoxylated products obtainable therefrom by alkoxylation, particularly those obtainable by reaction of alkyl glucosides with ethylene oxide.

Cationic surfactants contain hydrophilic functional groups where the charge of the functional groups are positive when dissolved or dispersed in an aqueous solution. Typical cationic surfactants include for example amine compounds, oxygen containing amines, and quaternary amine salts.

Amphoteric surfactants contain both acidic and basic hydrophilic groups. Amphoteric surfactants are preferably derivatives of secondary or tertiary amines, derivatives of quaternary ammonium, quaternary phosphonium or tertiary sulfonium compounds. The cationic atom in the quaternary compound can be part of a heterocyclic ring. The amphoteric surfactant preferably contains at least one aliphatic group, containing from about 3 to about 18 carbon atoms. At least one aliphatic group preferably contains an anionic water-solubilizing group such as a carboxy, sulfonate, sulfato, phosphato, or phosphono group.

Generally, anionic surfactants, such as linear alkyl sulfonate (LAS) is preferred for use in solid detergent formulations. Nonionic and anionic surfactant mixtures such as alcohol ethoxylates and LAS are preferred in liquid fabric washing compositions of this invention.

The fabric washing composition contains from 0 to 85 weight percent, and preferably from 5 to 50 weight percent of one or more builders based on the total weight of the composition. In the aqueous treatment solution, the one or more builders are preferably present at a concentration of from 25 ppm to 5000 ppm more preferably from 75 ppm to 500 ppm by weight based on the total weight of the aqueous treatment solution.

Examples of builders which may be present in the fabric washing composition include for example phosphates such as pyrophosphates, polyphosphates, or sodium tripolyphosphate. Further examples are zeolites, sodium carbonate, polycarboxylic acids, nitrilotriacetic acid, citric acid, tartaric acid, the salts of the aforesaid acids and the monomeric, oligomeric or polymeric phosphonates.

The amounts of the one or more builders used in the preparation of the fabric washing composition based on the total weight of the composition are, typically for example, up to 85 weight percent sodium carbonate, up to 45 weight percent phosphates, up to 40 weight percent zeolites, up to 30 weight percent nitrilotriacetic acid and phosphonates, and up to 30 weight percent polycarboxylic acids.

The amount of builder in a liquid fabric washing composition preferably is from 0 to 30 weight percent, more preferably from 1 to 20 weight percent based on the total weight of the composition. Suitable builders in a liquid fabric washing composition include for example citric acid and its salts, tripolyphosphate, fatty acid soap, tripolyphosphate, or combinations thereof.

Solvents, inert diluents, or water may be used in the fabric washing composition for dissolving or dispersing the dye transfer inhibiting agent.

Liquid fabric washing compositions can contain up to 80 weight percent water or solvent or combinations thereof. Typical solvents which may be used include oxygen containing solvents such as alcohols, esters, glycol, and glycol ethers. Alcohols that may be used in the present compositions include for example methanol, ethanol, isopropanol, and tertiary butanol. Esters which may be used include for example amyl acetate, butyl acetate, ethyl acetate, esters of glycols. Glycols and glycol ethers that are useful as solvents include for example ethylene glycol, propylene glycol, and oligomers of ethylene propylene glycol.

Solid detergent formulations preferably contain up to 60 weight percent of one or more solid inert diluents such as sodium sulfate, sodium chloride, sodium borate, or selected polymers such as polyethylene glycol or polypropylene glycol.

The fabric washing composition may contain 0 to about 50 weight percent of one or more buffering agents. Buffering agents include for example one or more alkali metal salts such as silicates, carbonates, or sulfates. Buffering agents also include for example, organic alkalis, such as triethanolamine, monoethanolamine, and triisopropanolamine.

Fabric softening agents typically include quaternary ammonium salts such as for example ditallowdimethylammonium chloride.

Other optional additives to a fabric washing composition, especially for cleaning are bleaching agents, used in an amount of up to 30 weight percent; corrosion inhibitors, such as silicates, used in an amount of up to 25 weight percent; other dye deposition inhibiting agents, used in an amount up to 20 weight percent; and graying inhibitors used in an amount of up to 5 weight percent.

Suitable bleaching agents are, for example, perborates, percarbonates or chlorine-generating substances, such as chloroisocyanurates. Suitable silicates used as corrosion inhibitors are, for example, sodium silicate, sodium disilicate and sodium metasilicate. Suitable other dye deposition inhibiting agents include for example poly(vinyl pyrrolidone). Examples of graying inhibitors are carboxymethylcellulose, methylcellulose, hydroxypropylmethylcellulose and graft copolymers of vinyl acetate and polyalkylene oxides having a molecular weight of 1,000 to 15,000.

EXAMPLES

Some embodiments of the invention will now be described in detail in the following Examples. The weight average molecular weight (Mw) of the soil protection agent useful in the present invention was measured in all examples by gel permeation chromatography using dimethylformamide as the reaction solvent and poly(vinyl pyrrolidone) having a molecular weight of 40,000 as the standard.

The ability of the dye deposition inhibiting polymer to inhibit the deposition of dye was tested under the following fabric washing process conditions 1) home laundering; 2) home laundering, without detergent; and 3) stonewashing.

For the home laundering test, an 83.3 liter Kenmore Fabric Care Series 80 Model 110 washing machine was used. To the Kenmore washing machine was added 1) test fabrics; 2) two (63.5 cm×101.6 cm) cotton terry bath towels 3) one cotton terry wash cloth which had 10 grams of used cooking oil dripped on to it; and 4) 15 grams of Ultra Tide® detergent (registered trademark of Procter & Gamble Company). The washer was then filled with 45 liters of tap water at a temperature of about 32° C. and hardiness of about 110 ppm to form an aqueous solution. As the washer was filling with the water, dye deposition inhibiting polymer was added to provide a final concentration of 75 ppm of the polymer in the aqueous solution. After the washer was almost filled with the water, dye was added in the amount indicated in Table 1.

TABLE 1

Dye Dosages for Tables 2–5

| Dye | Used in Table | Dosage (mg) |
|---|---|---|
| Direct Blue #1 | 2 | 220 |
| Direct Red #28 | 3 | 98 |
| Direct Black #22 | 4 | 3200 |
| Direct Blue #90 | 4 | 200 |
| Basic Blue #22 | 5 | 144 |

The dyes were obtained from either Pylam Products Company located in Garden City, N.Y.; Aldrich Chemical Company located in Milwaukee, Wis.; or Fisher Scientific located in Pittsburgh, Pa.

The washing machine was then started and the washing machine went through a 20 minute wash cycle, followed by one rinse cycle using tap water at a temperature of about 18° C. for 7 minutes. Also, each wash or rinse cycle was ended with a spin cycle to remove the wash liquor. Following the washing and rinse cycles, the test fabrics were removed from the washer and air dried.

The test fabrics for the home laundering test were cotton 405, cotton broadcloth, and a blended fabric composed of 65 weight percent polyester and 35 weight percent cotton (poly/cotton). These test fabrics were obtained from TestFabrics in Middlesex, N.J. and were cut into approximately 13 cm by 13 cm squares. To remove nonpermanent fabric finishes, the test fabrics were washed in hot (68° C.) water with ordinary laundry detergent and dried before testing. For each dye deposition inhibiting polymer tested, five test fabrics of each type were washed for a total of fifteen test fabrics per test.

The dye deposition inhibiting polymer was evaluated for its effectiveness by measuring the color intensity of each test fabric. The color intensity was determined by measuring the reflectance (Y) of the fabric using a colorimeter (Colorguard® System/05, manufactured by Gardner). Higher Y reflectance values correspond to a whiter fabric which is desirable because it indicates less dye deposited onto the fabric. For each test fabric type, an average reflectance (Avg Y) was calculated by averaging together the reflectance (Y) of the 5 test fabrics.

This average reflectance (Avg Y) for each fabric type was compared to the average reflectance of the test fabric washed with no dye deposition inhibiting polymer, but at the same test conditions. The ΔY value shown in TABLES 2–5 is the difference in the reflectance of the test fabric washed with the dye deposition inhibiting polymer minus the reflectance value of the test fabric washed without dye deposition inhibiting polymer. Therefore, a positive ΔY value indicates that the polymer tested is inhibiting the deposition of dye more effectively than having no test polymer. A test polymer having a greater positive ΔY value is more effective in inhibiting the deposition of dye in comparison to another test polymer having a lower positive ΔY value. A zero or negative ΔY value means the polymer tested is providing no dye deposition inhibiting benefits in comparison to having no test polymer.

This home laundering test method is actually more severe because all the dye was added into the bath simultaneously at the beginning of the wash cycle. In a real fabric wash process the dye would only be gradually released from the fabric. When the dye is gradually released, the dye deposition inhibiting polymer has to inhibit a lower concentration of dye throughout most of the process.

The results of testing the dye deposition inhibiting polymer useful in the present invention under home laundering conditions for dye deposition inhibition are shown in TABLES 2–5. The results in TABLES 2–5 show that the dye deposition inhibiting polymer is effective in inhibiting different dyes, including anionic and cationic dyes.

In TABLE 2, the dye deposition inhibiting polymer was tested for effectiveness in inhibiting direct blue #1, an anionic dye. TABLE 2 shows the dye deposition inhibiting polymer useful in the present invention is effective in inhibiting direct blue #1. Comparatives 1 and 2, containing 50 weight percent acrylic acid and 50 weight percent vinyl amide monomer were not effective in inhibiting the deposition of direct blue #1 in comparison to no polymer.

TABLE 2

Effectiveness of the Dye Deposition Inhibiting Polymer in Inhibiting Direct Blue #1

| | | | Δ Reflectance (Δ Y) | | |
|---|---|---|---|---|---|
| Example | Composition of Dye Deposition Inhibiting Polymer | Mw | Cot. 405 | Cot. Broad Cloth | Poly/ Cot. |
| No Polymer | — | — | 0.0 | 0.0 | 0.0 |
| Comparative 1 | 50 NVF/50 AA | n.d. | −4.2 | −5.4 | −1.7 |
| Comparative 2 | 50 NVA/50 AA | n.d. | −7.7 | −9.3 | −4.3 |
| Comparative 3 | 50 AM/50 VA | 66,283 | 0.9 | — | — |
| Comparative 4 | PVP | 36,000 | 17.5** | 16.0* | 6.9* |
| Example 1 | 100 NVF | n.d. | 14.2 | 13.7 | 4.8 |
| Example 2 | 50 NVF/50 VA | 19,523 | 11.9 | 8.2 | 4.0 |
| Example 3 | 20 NVF/80 VA | 19,289 | 10.7 | 7.9 | 3.2 |
| Example 4 | 50 NVF/50 NVA | 20,516 | 20.0 | 18.1 | 8.0 |
| Example 5 | 50 NVF/HEMA | 128,885 | 13.8 | 13.0 | 6.3 |
| Example 6 | 100 NVA | 143,894 | 12.5 | 9.2 | 3.9 |
| Example 7 | 50 NVA/50 VA | 24,315 | 20.1 | 18.2 | 8.2 |
| Example 8 | 30 NVA/70 VA | 35,741 | 18.8 | 17.2 | 7.9 |
| Example 9 | 20 NVA/80 VA | 26,096 | 18.3 | 17.5 | 9.0 |
| Example 10 | 10 NVA/90 VA | 26,843 | 5.9 | 4.8 | 4.1 |

*average of 6 data points; **average of 7 data points

In TABLE 3, the dye deposition inhibiting polymer was tested for effectiveness in inhibiting direct red #28, an anionic dye. TABLE 3 shows that the dye deposition inhibiting polymer useful in the present invention is not as effective in inhibiting the deposition of direct red #28 in comparison to the results in TABLE 2 for direct blue #1. Comparative 7, a homopolymer of poly(vinylpyrrolidone), a known dye deposition inhibitor, is also not as effective in comparison to the results in TABLE 2. The less effective results in TABLE 3 may be due to direct red #28 having low solubility in aqueous solutions.

TABLE 3

Effectiveness of the Dye Deposition Inhibiting Polymer in Inhibiting Direct Red #28

| | | | Δ Reflectance (Δ Y) | | |
|---|---|---|---|---|---|
| Example | Composition of Dye Deposition Inhibiting Polymer | Mw | Cot. 405 | Cot. Broad Cloth | Poly/ Cot. |
| No Polymer | — | — | 0.0 | 0.0 | 0.0 |
| Comparative 5 | 50 NVF/50 AA | n.d. | 0.4 | −0.6 | −0.4 |
| Comparative 6 | 50 NVA/50 AA | n.d. | 0.9 | −0.3 | 0.1 |
| Comparative 7 | PVP | 36,000 | 2.2** | 0.8* | 2.3* |
| Example 11 | 100 NVF | n.d. | −0.3 | 0.0 | 0.4 |
| Example 12 | 50 NVF/50 VA | 19,523 | −0.7 | −2.8 | 1.6 |
| Example 13 | 20 NVF/80 VA | 19,289 | −5.6 | −7.7 | −0.4 |
| Example 14 | 50 NVF/50 NVA | 20,516 | −2.3 | −3.4 | −1.0 |
| Example 15 | 50 NVF/HEMA | 128,885 | −0.4 | −0.3 | 0.5 |
| Example 16 | 100 NVA | 143,894 | 2.2 | −0.6 | 2.8 |
| Example 17 | 50 NVA/50 VA | 24,315 | 1.2 | −1.5 | 0.5 |
| Example 18 | 30 NVA/70 VA | 35,741 | 0.3 | −2.5 | 1.0 |
| Example 19 | 20 NVA/80 VA | 26,096 | −3.5 | −6.1 | −0.3 |
| Example 20 | 10 NVA/90 VA | 26,843 | −0.2 | −2.1 | −2.2 |

*average of 6 data points; **average of 7 data points

In TABLE 4, the dye deposition inhibiting polymer was tested for effectiveness in inhibiting direct blue #90 and direct black #22, both anionic dyes. TABLE 4 shows that the dye deposition inhibiting polymer useful in the present invention is effective in inhibiting direct blue #90 and direct black #22. Example 23 shows the dye deposition inhibiting polymer useful in the present invention is effective when present in the aqueous solution at a concentration of 12.5 ppm by weight. TABLE 4 also shows that Comparative 8, a copolymer containing acrylamidoalkylene sulfonic acid is not as effective in inhibiting the deposition of direct blue #90 in comparison to Examples 21, 22, and 24.

TABLE 4

Effectiveness of Dye Deposition Inhibiting Polymer in Inhibiting Direct Blue #90 and Direct Black #22

| Example | Composition of Dye Deposition Inhibiting Polymer | Dose (ppm) | Mw | Dye | Δ Reflectance (Δ Y) Cot. 405 | Cot. Broad Cloth | Poly/ Cot. |
|---|---|---|---|---|---|---|---|
| No Polymer | — | — | — | Blue #90 | 0.0 | 0.0 | 0.0 |
| No Polymer | — | — | — | Black #22 | 0.0 | 0.0 | 0.0 |
| Comparative 8 | Hostadrill ® V3118 | 75.0 | n.d. | Blue #90 | 1.4 | 2.4 | 1.3 |
| Example 21 | 30 NVF/70 VA | 75.0 | 153,073 | Blue #90 | 16.5 | 19.5 | 7.9 |
| Example 22 | 30 NVF/70 VA | 75.0 | 76,151 | Blue #90 | 16.8 | 20.2 | 6.7 |
| Example 23 | 30 NVF/70 VA | 12.5 | 116,476 | Blue #90 | 4.2 | 5.5 | 3.5 |
| Example 24 | 26 NVF/61 VA/13 DIB | 75.0 | n.d. | Blue #90 | 6.0 | 5.9 | 5.4 |
| Example 25 | 30 NVF/70 VA | 75.0 | 76,151 | Black #22 | 7.7 | 11.0 | 4.9 |
| Example 26 | 26 NVF/61 VA/13 DIB | 75.0 | n.d. | Black #22 | 11.1 | 13.5 | 5.6 |

In TABLE 5, the dye deposition inhibiting polymer was tested for effectiveness in inhibiting basic blue #9, a cationic dye. TABLE 5 shows that the dye deposition inhibiting polymer useful in the present invention is somewhat effective in inhibiting the deposition of basic blue #9.

TABLE 5

Effectiveness of Dye Deposition Inhibiting Polymer in Inhibiting Basic Blue #9

| Example | Composition of Deposition Inhibiting Polymer | Mw | Δ Reflectance (Δ Y) Cot. 405 | Cot. Broad Cloth | Poly/ Cot. |
|---|---|---|---|---|---|
| No Polymer | — | — | 0.0 | 0.0 | 0.0 |
| Comparative 9 | Hostadrill ® V3118 | n.d. | −2.9 | −2.5 | −0.4 |
| Example 27 | 30 NVF/70 VA | 153,073 | 0.7 | 0.7 | 1.6 |

The dye deposition inhibiting polymer of the present invention was also evaluated using the home laundering test procedure described previously except that the detergent was not added to the washer and the cotton terry wash cloth with cooking oil was not added to the washer. The reflectance of the test fabrics was measured as in Examples 1–27. The amount of dye used in this test was 50 mg of direct blue #90. The results are summarized in TABLE 6.

The results in TABLE 6 show that the dye deposition inhibiting polymer is effective in inhibiting the deposition of dye when no detergent is present in the aqueous solution.

TABLE 6

Effectiveness of Dye Deposition Inhibiting Polymer in Inhibiting Direct Blue #90 with No Added Detergent

| Example | Composition of Dye Deposition Inhibiting Polymer | Mw | Δ Reflectance (Δ Y) Cot. 405 | Cot. Broad Cloth | Poly/ Cot. |
|---|---|---|---|---|---|
| No Polymer | — | — | 0.0 | 0.0 | 0.0 |
| Example 28 | 30 NVF/70 VA | 76,151 | 3.5 | 3.9 | 1.8 |

The dye deposition inhibiting polymer was also evaluated under stone washing conditions using the following test procedure. The dye deposition inhibiting polymer was evaluated in a Terg-O-tometer (Model Number 7243S, manufactured by United States Testing Company, Inc. Hoboken, N.J.) having three 1 liter pots (Model Number 7243S, manufactured by United States Testing Company, Inc. Hoboken, N.J.). To each 1 liter pot was added 32.8 grams of a 2 weight percent aqueous solution of indigo blue and 250 mg of dye deposition inhibiting polymer. The three pots were then filled to 1 liter with deionized water having a temperature of 21° C. to form an aqueous solution. Each pot was agitated for 5 minutes after which the aqueous solution was adjusted to a pH of 5.5 with dilute acetic acid.

Next, five different 13 cm by 13 cm test fabrics were added to each pot. The five different test fabrics were cotton 405, cotton broadcloth, poly/cotton, cotton duck and 100 weight percent polyester. The cotton duck and polyester were also obtained from TestFabrics. All the test fabrics were prewashed according to the procedure described for the home laundering test.

The pots were then agitated for 20 minutes at 100 rpm and the wash temperature was maintained at 21° C. After 20 minutes, the agitation was stopped and the test fabrics were removed from each pot. The aqueous solution was removed from each pot and each pot was refilled to 1 liter with deionized water at a temperature of 21° C. The test fabrics were then returned to the pot and agitated at 100 rpm for a rinse cycle. After 5 minutes, the test fabrics were removed from the pot and spun dry for a few minutes in a European style front loader washing machine. The test fabrics were then air dried overnight. The reflectance of each test fabric was measured according to the procedures described for the home laundering test.

TABLE 7 shows the results of testing the dye deposition inhibiting polymer under stonewashing type conditions for dye deposition inhibition. Examples 29–33 show that the dye deposition inhibiting polymer useful in the present invention is effective in inhibiting the deposition of indigo blue, a nonionic dye in comparison to no polymer.

TABLE 7

Effectiveness of Dye Deposition Inhibiting Polymer Under Stone Washing Conditions

| Example | Composition of Dye Deposition Inhibiting Polymer | Mw | Test Fabric | Net Change in Reflectance (Δ Y) |
|---|---|---|---|---|
| No Polymer | — | — | poly/cot. | 0 |
| No Polymer | — | — | cot. 405 | 0 |
| No Polymer | — | — | cot. broad cloth | 0 |
| No Polymer | — | — | cot. duck | 0 |
| No Polymer | — | — | polyester | 0 |
| Example 29 | 30 NVF/70 VA | 32,698 | poly/cot. | 28.1 |
| Example 30 | 30 NVF/70 VA | 32,698 | cot. 405 | 27.0 |
| Example 31 | 30 NVF/70 VA | 32,698 | cot. broad cloth | 32.4 |
| Example 32 | 30 NVF/70 VA | 32,698 | cot. duck | 39.4 |
| Example 33 | 30 NVF/70 VA | 32,698 | polyester | 31.3 |

The dye deposition inhibiting polymer useful in the present invention may be formulated into detergent formulations. TABLE 8 shows some examples of liquid detergent formulations containing dye deposition inhibiting polymer which may be prepared. Formulation A is built with citrate and fatty acid soap; formulation B is built with phosphate; and formulation C contains no builder. TABLE 9 shows some examples of powder detergent formulations containing dye deposition inhibiting polymer which can be prepared. Formulation D is built with tripolyphosphate; formulation E is built with pyrophosphate; and formulation F is built with zeolite.

TABLE 8

Typical Liquid Detergent Formulations Containing Dye Deposition Inhibiting Polymer

| Ingredient | A | B | C |
|---|---|---|---|
| Linear alkyl benzene sulfonate | 8 wt % | 7 wt % | 19 wt % |
| Alcohol ether sulfate | 16 wt % | — | — |
| Nonionic surfactant | 6 wt % | 3 wt % | 15 wt % |
| Enzyme | 0.5 wt % | 0.5 wt % | 0.75 wt % |
| Dye Deposition Inhibiting Polymer | 2.0 wt % | 2.0 wt % | 2.0 wt % |
| Sodium citrate | 6.0 wt % | — | — |
| Fatty Acid Soap | 10 wt % | — | — |
| Tripolyphosphate | — | 23 wt % | — |
| Propylene glycol | 8 wt % | — | 4 wt % |
| Ethanol | 4 wt % | — | 8.5 wt % |
| Sodium Xylene Sulfonate | — | — | — |
| Borax | — | 3.0 | — |
| Glycerin | — | 6.0 | — |
| Optical Brightener | 0.15 wt % | 0.10 wt % | 0.25 wt % |
| Water | Balance | Balance | Balance |

TABLE 9

Typical Powder Detergent Formulations Containing Dye Deposition Inhibiting Polymer

| Ingredient | D | E | F |
|---|---|---|---|
| Linear alkyl benzene sulfonate | 5 wt % | 5 wt % | 7.5 wt % |
| Lauryl sulfate | 8 wt % | 13 wt % | — |
| Alcohol ether sulfate | 3 wt % | — | — |
| Nonionic surfactant | 1.5 wt % | 2.0 wt % | — |
| Sodium Perborate | — | — | 22.5 wt % |
| Anti-redeposition agent | — | — | 0.5 wt % |
| Sodium polyacrylate | 0.5 wt % | 0.5 wt % | 0.5 wt % |
| Dye Deposition Inhibiting | 2.0 wt % | 2.0 wt % | 2.0 wt % |

TABLE 9-continued

Typical Powder Detergent Formulations Containing Dye Deposition Inhibiting Polymer

| Ingredient | D | E | F |
|---|---|---|---|
| Polymer | | | |
| Tripolyphosphate | 30.0 wt % | — | — |
| Pyrophosphate | — | 18.0 wt % | — |
| Zeolite A | — | — | 25.0 wt % |
| Sodium Carbonate | 10 wt % | 13 wt % | 7.5 wt % |
| Sodium silicate | 6 wt % | 5 wt % | 1.5 wt % |
| Enzyme | 0.5 wt % | 0.5 wt % | 0.5 wt % |
| Optical Brightener | 0.2 wt % | 0.2 wt % | 0.2 wt % |
| Sodium Sulfate | 15.0 wt % | 24.0 wt % | 20.0 wt % |
| Water | Balance | Balance | Balance |

TABLE 10

Key To Abbreviations Used In Tables 1–9

| ABBREVIATION | KEY |
|---|---|
| AA | percent by weight acrylic acid |
| AM | percent by weight acrylamide |
| Cot. | cotton |
| DIB | percent by weight diisobutylene |
| HEMA | percent by weight hydroxyethyl methacrylate |
| Hostadrill ® | copolymer containing acrylamidoalkylene sulfonic acid, |
| V3118 | registered trademark of Hoechst AG |
| n.d. | no data |
| NVA | pereent by weight N-vinyl-N-methylacetamide |
| NVF | percent by weight N-vinyl formamide |
| PVP | percent by weight poly(vinyl pyrrolidone) |
| VA | percent by weight vinyl acetate |

We claim:

1. A fabric washing composition for inhibiting deposition of dye, comprising: at least one additive selected from the group consisting of a surfactant, fabric softening agent and combinations thereof, and from 0.01 to 20 weight percent, based on the total weight of the composition, of at least one dye deposition inhibiting polymer, wherein the dye deposition inhibiting polymer inhibits the deposition of dye, has a weight average molecular weight from 5,000 to 200,000, and comprises, as polymerized units, based on total weight of monomer, from 5 to 100 weight percent of at least one vinyl amide monomer having a structure of Formula (I)

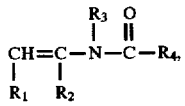

Formula (I)

from 0 to 95 weight percent of one or more vinyl ester monomers, less than 3 weight percent of one or more acrylamide monomers, and less than 3 weight percent of one or more ethylenically unsaturated carboxylic acid monomers;

wherein $R_1$, $R_2$, and $R_3$ are each independently hydrogen, or a straight, cyclic, or branched chain $C_1$–$C_{10}$ alkyl group;

wherein $R_4$ is hydrogen, a straight or branched chain $C_1$–$C_{18}$ alkyl, aryl, or alkylaryl group, or a substituent of Formula (III), $$-((CH_2)_nO)_m-H; \quad \text{(Formula (III))}$$

and wherein n is an integer from 1 to 6 and m is an integer from 1 to 30.

2. The fabric washing composition of claim 1, wherein the vinyl ester monomers of the dye deposition inhibiting polymer have the structure of Formula (II):

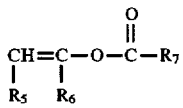

Formula (II)

wherein $R_5$ and $R_6$ are each independently hydrogen, or a straight, cyclic, or branched chain $C_1$–$C_{10}$ alkyl group;

wherein $R_7$ is hydrogen, a straight or branched chain $C_1$–$C_{18}$ alkyl, aryl, or alkylaryl group, or a substituent of Formula (III), $$-((CH_2)_nO)_m-H; \quad \text{Formula (III)}$$

and wherein n is an integer from 1 to 6 and m is an integer from 1 to 30.

3. The fabric washing composition of claim 1, wherein the vinyl amide monomer is selected from the group consisting of: N-vinylformamide, N-vinylacetamide, N-vinyl-N-methylacetamide, and combinations thereof.

4. The fabric washing composition of claim 1, wherein the one or more vinyl ester monomers are selected from the group consisting of: vinyl acetate, vinyl propionate, vinyl butyrate, vinyl pivalate, vinyl laurate, vinyl decanoate, and combinations thereof.

5. The fabric washing composition of claim 1, wherein the dye deposition inhibiting polymer contains from 15 to 70 weight percent of the vinyl amide monomer based on the total weight of monomer.

6. The fabric washing composition of claim 1, wherein the dye deposition inhibiting polymer contains from 30 to 85 weight percent of the vinyl ester monomers based on the total weight of monomer.

7. The fabric washing composition of claim 1, wherein the dye deposition inhibiting polymer is a copolymer comprising, as polymerized units, N-vinylformamide and vinyl acetate.

8. The fabric washing composition of claim 1, wherein the dye deposition inhibiting polymer further comprises from 1 to 20 weight percent of one or more other nonionic ethylenically unsaturated monomers.

9. The fabric washing composition of claim 1, wherein the dye deposition inhibiting polymer has a weight average molecular weight of from 5,000 to 100,000.

10. The fabric washing composition of claim 1, wherein the dye deposition inhibiting polymer has a weight average molecular weight of from 5,000 to 60,000.

11. The fabric washing composition of claim 1, wherein the dye deposition inhibiting polymer comprises from 15 to 100 weight percent of the vinyl amide monomer based on the total monomer weight.

12. A method of inhibiting deposition of dye onto fabric in a fabric washing process, comprising:

a) forming a bath comprising water, at least one dyed fabric, and at least one dye deposition inhibiting polymer; and b) contacting the dye deposition inhibiting polymer with the dyed fabric in said bath to inhibit the deposition of dye;

wherein the dye deposition inhibiting polymer has a weight average molecular weight from 5,000 to 200,000, and comprises, as polymerized units, based on total weight of monomer, from 5 to 100 weight percent, of at least one vinyl amide monomer, having a structure of Formula (I),

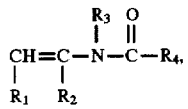

Formula (I)

from 0 to 95 weight percent of one or more vinyl ester monomers, less than 3 weight percent of one or more acrylamide monomers, and less than 3 weight percent of one or more ethylenically unsaturated carboxylic acid monomers; and wherein $R_1$, $R_2$, and $R_3$ are each independently hydrogen, or a straight, cyclic, or branched chain $C_1$–$C_{10}$ alkyl group;

wherein $R_4$ is hydrogen, a straight or branched chain $C_1$–$C_{18}$ alkyl, aryl, or alkylaryl group, or a substituent of Formula (III), $$-((CH_2)_nO)_m-H; \quad \text{Formula (III)}$$

and wherein n is an integer from 1 to 6 and m is an integer from 1 to 30.

13. The method of claim 12, wherein the vinyl amide monomer is selected from the group consisting of: N-vinylformamide, N-vinylacetamide, N-vinyl-N-methylacetamide and combinations thereof.

14. The method of claim 12, wherein the one or more vinyl ester monomers are selected from the group consisting of: vinyl acetate, vinyl propionate, vinyl butyrate, vinyl pivalate, vinyl laurate, vinyl decanoate, and combinations thereof.

15. The method of claim 11, wherein the dye deposition inhibiting polymer has a weight average molecular weight of from 5,000 to 100,000.

16. An aqueous treatment solution for inhibiting the deposition of dye, comprising: water, surfactant, and from 1 ppm to 10,000 ppm of at least one dye deposition inhibiting polymer;

wherein the dye deposition inhibiting polymer inhibits the deposition of dye, has a weight average molecular weight from 5,000 to 200,000, and comprises, as polymerized units, based on total weight of monomer, from 5 to 100 weight percent, of at least one vinyl amide monomer, having a structure of Formula (I)

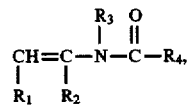

Formula (I)

from 0 to 95 weight percent of one or more vinyl ester monomers, less than 3 weight percent of one or more acrylamide monomers, and less than 3 weight percent of one or more ethylenically unsaturated carboxylic acid monomers;

wherein $R_1$, $R_2$, and $R_3$ are each independently hydrogen, or a straight, cyclic, or branched chain $C_1$–$C_{10}$ alkyl group;

wherein $R_4$ is hydrogen, a straight or branched chain $C_1$–$C_{18}$ alkyl, aryl, or alkylaryl group, or a substituent of Formula (III), $$-((CH_2)_nO)_mH; \qquad \text{Formula (III)}$$

and wherein n is an integer from 1 to 6 and m is an integer from 1 to 30.

17. The aqueous treatment solution of claim 16, wherein the vinyl amide monomer is selected from the group consisting of: N-vinylformamide, N-vinylacetamide, N-vinyl-N-methylacetamide and combinations thereof.

18. The aqueous treatment solution of claim 16, wherein the one or more vinyl ester monomers are selected from the group consisting of: vinyl acetate, vinyl propionate, vinyl butyrate, vinyl pivalate, vinyl laurate, vinyl decanoate, and combinations thereof.

19. The aqueous treatment solution of claim 16, wherein the dye deposition inhibiting polymer has a weight average molecular weight of from 5,000 to 100,000.

* * * * *